US007329088B2

(12) United States Patent
Barrett et al.

(10) Patent No.: US 7,329,088 B2
(45) Date of Patent: Feb. 12, 2008

(54) PILOT RELIEF TO REDUCE STRUT EFFECTS AT PILOT INTERFACE

(75) Inventors: John R. Barrett, Mesa, AZ (US); Alonso J. Garcia, Tucson, AZ (US); Robert A. Kime, Chandler, AZ (US)

(73) Assignee: Honeywell International, Inc., Morristown, NJ (US)

( * ) Notice: Subject to any disclaimer, the term of this patent is extended or adjusted under 35 U.S.C. 154(b) by 154 days.

(21) Appl. No.: 11/282,230

(22) Filed: Nov. 17, 2005

(65) Prior Publication Data

US 2007/0110568 A1 May 17, 2007

(51) Int. Cl.
*F01D 25/24* (2006.01)

(52) U.S. Cl. ..... 415/136; 415/142; 415/173.1; 415/229

(58) Field of Classification Search ..... 415/136, 415/138, 142, 173.1, 173.3, 214.1, 229; 60/799
See application file for complete search history.

(56) References Cited

U.S. PATENT DOCUMENTS 2,616,662 A 11/1952 Mierley
3,489,340 A * 1/1970 Holzhausen ..... 415/214.1
4,074,914 A * 2/1978 Novotny ..... 415/214.1
4,076,452 A 2/1978 Hartmann
4,181,466 A 1/1980 Owen
4,248,566 A 2/1981 Chapman et al.
4,786,232 A * 11/1988 Davis et al. ..... 415/138
4,979,872 A 12/1990 Myers et al.
5,108,258 A 4/1992 Gros
5,490,186 A 2/1996 Gilmore et al.
6,030,176 A 2/2000 Oeynhausen
6,224,332 B1 5/2001 Leach et al.
6,244,819 B1 6/2001 Voorhees
6,612,807 B2 9/2003 Czachor
6,821,083 B2 11/2004 Lathrop et al.
6,823,970 B2 11/2004 Hayes et al.
7,008,182 B2 * 3/2006 Kopp et al. ..... 415/136

FOREIGN PATENT DOCUMENTS

EP 1460237 A1 * 9/2004

* cited by examiner

*Primary Examiner*—Christopher Verdier
(74) *Attorney, Agent, or Firm*—Ingrassia Fisher & Lorenz

(57) ABSTRACT

A turbine section of an engine that includes a shaft, a plurality of blades extending radially relative to the shaft, a bearing assembly, a flowpath housing, and a shroud is provided. The bearing assembly is mounted to the shaft adjacent to the plurality of blades. The flowpath housing is coupled to the bearing assembly and includes an inner cylinder, an outer cylinder, and a strut. The inner and outer cylinders each include a strut attachment point between which the strut is coupled, and the outer cylinder includes an outer surface. The shroud is disposed concentric to the outer cylinder and has an inner surface including a groove formed therein that is substantially aligned with the outer cylinder strut attachment point. The groove has a depth that provides and maintains a gap between the outer cylinder outer surface and the shroud inner surface when the flowpath housing is exposed to heat and the strut radially expands.

19 Claims, 5 Drawing Sheets

PILOT RELIEF TO REDUCE STRUT EFFECTS AT PILOT INTERFACE

TECHNICAL FIELD

The present invention relates to a gas turbine engine and, more particularly, to a shroud in a turbine section of the gas turbine engine.

BACKGROUND

A gas turbine engine may be used to power various types of vehicles and systems. A particular type of gas turbine engine that may be used to power an aircraft is a turbofan gas turbine engine. A turbofan gas turbine engine may include, for example, a fan section, a compressor section, a combustor section, a turbine section, and an exhaust section. The fan section is positioned at the front of the engine, and includes a fan that induces air from the surrounding environment into the engine and accelerates a fraction of this air toward the compressor section. The remaining fraction of induced air is accelerated into and through a bypass plenum, and out the exhaust section.

The compressor section is configured to raise the pressure of the air to a relatively high level and includes an impeller that has a plurality of blades extending therefrom that accelerate and compress the air. The compressed air then exits the compressor section, and is energized by the combustor section. Next, the energized air is directed into the turbine section, which includes a rotor and a plurality of turbine blades that are mounted thereto. The air impinges the turbine blades and causes the rotor to rotate and to generate energy.

To protect the rotor blades from tip loss, a suitably sized annular shroud surrounds the rotor blades. Typically, the annular shroud and blades define a radial clearance gap therebetween that is sufficiently large to allow the blades to rotate without contacting the shroud, while small enough to optimize engine efficiency. Thus, maintaining the annular shroud in a particular position relative to the blades is preferable.

In one positioning configuration, the annular shroud is coupled to a cylindrical flowpath housing that is mounted around the rotor. Both the turbine shroud and flowpath housing include pilots that mate with each other to ensure proper radial positioning of the shroud on the flowpath housing. In many cases, the shroud pilot is an annular protruding ring formed on the shroud inner surface and the flowpath housing pilot is a corresponding structure formed on the flowpath housing outer surface. In many gas turbine engine configurations, the flowpath housing also includes a plurality of support struts that radially extend at least partially therethrough.

During engine operation, exposure to the energized air from the combustor section may cause the flowpath housing struts to expand radially outwardly at a rate that is faster than the radial expansion rate of the cylindrical flowpath housing. Accordingly, the flowpath housing may become misshapen, and may consequently form a rectangular-shaped component. As a result, the annular shroud may become misshapen, thereby undesirably altering the configuration of the clearance gap and the positioning of the shroud relative to the flowpath housing.

Therefore, there is a need for a shroud that allows the flowpath housing to radially expand without compromising the configuration of the clearance gap. Additionally, it is desirable for the shroud to be simple and inexpensive to manufacture and to implement.

BRIEF SUMMARY

The present invention provides a turbine section of an engine that includes a shaft, a plurality of blades extending radially relative to the shaft, a bearing assembly, a flowpath housing, and a shroud. The bearing assembly is mounted to the shaft adjacent to the plurality of blades. The flowpath housing is coupled to the bearing assembly and includes an inner cylinder, an outer cylinder, and a strut. The inner and outer cylinders each include a strut attachment point between which the strut is coupled, and the outer cylinder includes an outer surface. The shroud is disposed concentric to the outer cylinder and has an inner surface including a groove formed therein that is substantially aligned with the outer cylinder strut attachment point. The groove has a depth that provides and maintains a gap between the outer cylinder outer surface and the shroud inner surface when the flowpath housing is exposed to heat and the strut radially expands.

In another embodiment, and by way of example only, the turbine section of the engine includes a shaft, a plurality of blades extending radially relative to the shaft, a bearing assembly mounted to the shaft adjacent to the plurality of blades, a flowpath housing coupled to the bearing assembly, and a shroud. The flowpath housing includes an inner cylinder, an outer cylinder, and a plurality of struts, where the inner and outer cylinders each includes a plurality of strut attachment points between which the plurality of struts extend, and the outer cylinder includes an outer surface and an annular protrusion formed on the outer surface. The shroud is disposed concentric to the outer cylinder and has an inner surface and an annular protrusion formed on the inner surface. The shroud annular protrusion is configured to mate with the flowpath housing annular protrusion and includes a plurality of grooves formed therein, where at least one groove corresponds to and aligns with selected ones of the outer cylinder strut attachment points and has a depth that provides a gap between the outer cylinder outer surface and the shroud inner surface that is maintained when the flowpath housing is exposed to heat and the strut radially expands.

In still another embodiment, and by way of example only, the turbine section includes a shaft, a plurality of blades extending radially relative to the shaft, a bearing assembly mounted to the shaft adjacent to the plurality of blades, a flowpath housing, and a shroud. The flowpath housing is coupled to the bearing assembly and includes an inner cylinder, an outer cylinder, and a plurality of struts, where the inner and outer cylinders each includes strut attachment points between which the plurality of struts are coupled, the outer cylinder includes an outer surface, and the plurality of struts are disposed in a predetermined pattern. The shroud is disposed concentric to the outer cylinder and includes an inner surface having a plurality of grooves formed therein. At least one of the plurality of grooves is aligned with selected ones of the outer cylinder strut attachment points and has a depth that is configured to provide a gap between the outer cylinder outer surface and the inner surface that is maintained when the flowpath housing is exposed to heat and the strut radially expands.

Other independent features and advantages of the preferred turbine section will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
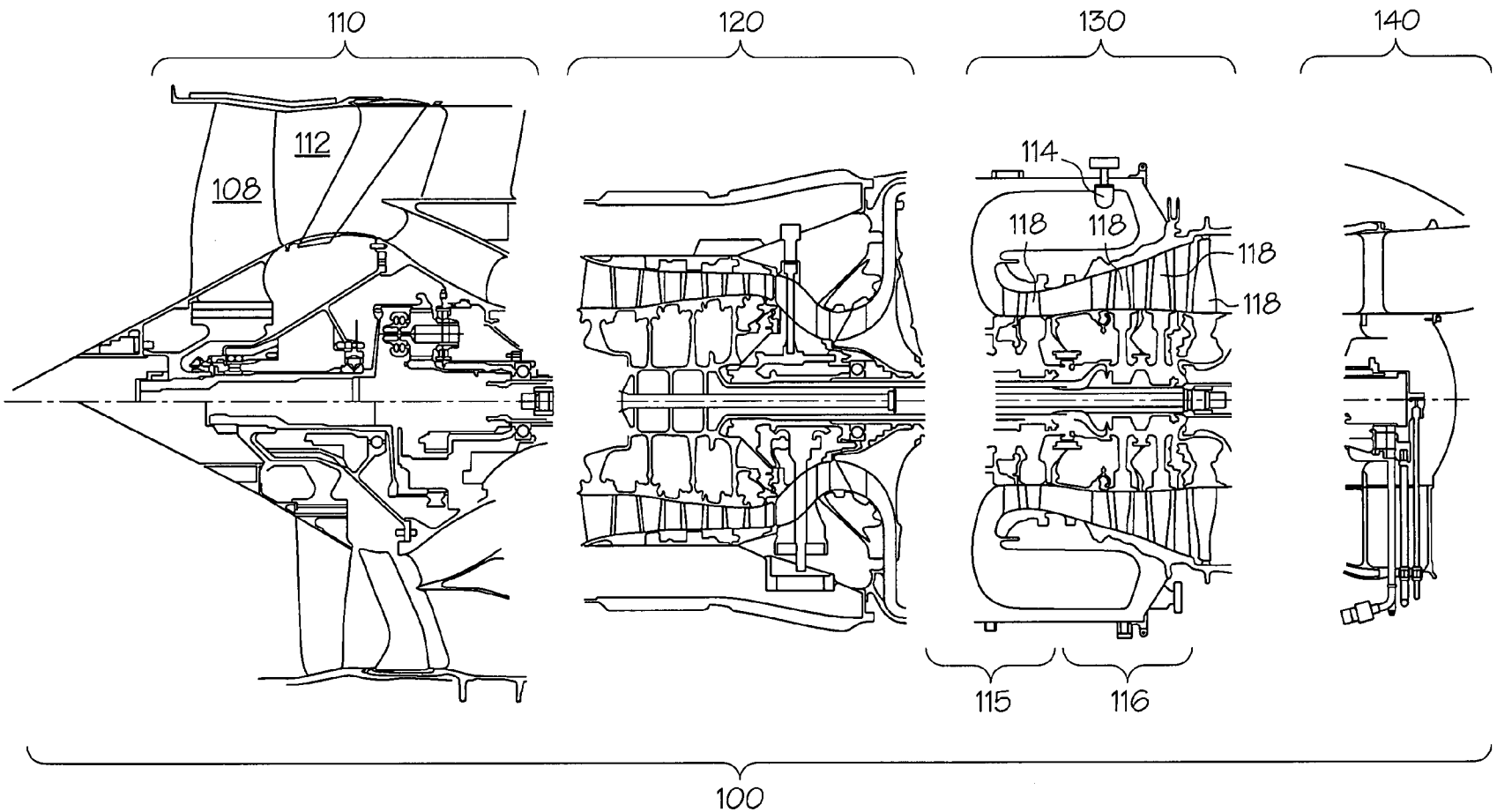
FIG. 1 is a cross section of a gas turbine engine.

Turning now to the description, and with reference first to FIG. 1, a schematic of an embodiment of a turbofan jet engine 100 is depicted. The turbofan jet engine 100 includes a fan module 110, a compressor module 120, a combustor and turbine module 130 and an exhaust module 140. The fan module 110 is positioned at the front, or "inlet" section of the engine 100, and includes a fan 108 that induces air from the surrounding environment into the engine 100. The fan module 110 accelerates a fraction of this air toward the compressor module 120, and the remaining fraction is accelerated into and through a bypass, and out the exhaust module 140. The compressor module 120 raises the pressure of the air it receives to a relatively high level.

The high-pressure compressed air then enters the combustor and turbine module 130, where a ring of fuel nozzles 114 injects a steady stream of fuel. The injected fuel is ignited by a burner (not shown), which significantly increases the energy of the high-pressure compressed air. This high-energy compressed air then flows first into a high pressure turbine 115 and then a low pressure turbine 116, causing rotationally mounted turbine blades 118 on each turbine 115, 116 to turn and generate energy. The energy generated in the turbines 115, 116 is used to power other portions of the engine 100, such as the fan module 110 and the compressor module 120. The air exiting the combustor and turbine module 130 then leaves the engine 100 via the exhaust module 140. The energy remaining in the exhaust air aids the thrust generated by the air flowing through the bypass 112.

Figure 2:
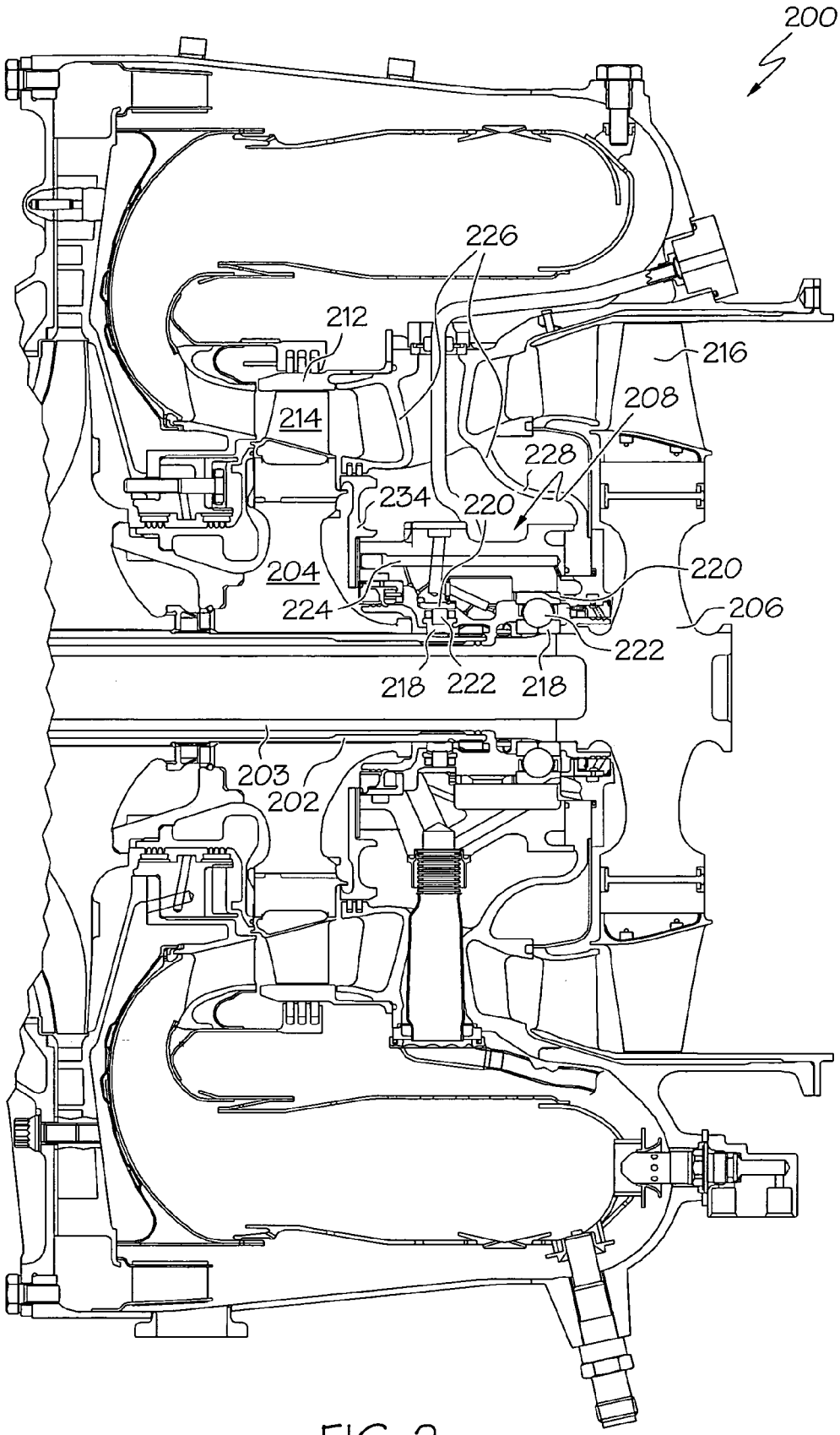
FIG. 2 is a cross section of an turbine section that may be implemented into the gas turbine engine of FIG. 1.

With reference now to FIG. 2, an exemplary turbine section 200 that may be implemented into the combustor and turbine module 130 of the turbofan jet engine 100 is illustrated. The turbine section 200 includes a high pressure turbine 204, a low pressure turbine 206, a bearing assembly 208, a flowpath housing 226, and a shroud 212. The high and low pressure turbines 204, 206 are each mounted to rotors 202, 203 and rotate therewith. Each of the turbines 204, 206 include a plurality of blades 214, 216, respectively, that extend radially outwardly relative to the rotors 202, 203, respectively.

The bearing assembly 208 is disposed between the turbines 204, 206 and each includes inner rings 218, corresponding outer rings 220, and a plurality of bearings 222 disposed therebetween. The inner and outer rings 218, 220 and bearings 222 are disposed within a bearing housing 224 that is supported by, and coupled, to the flowpath housing 226.

Figure 3:
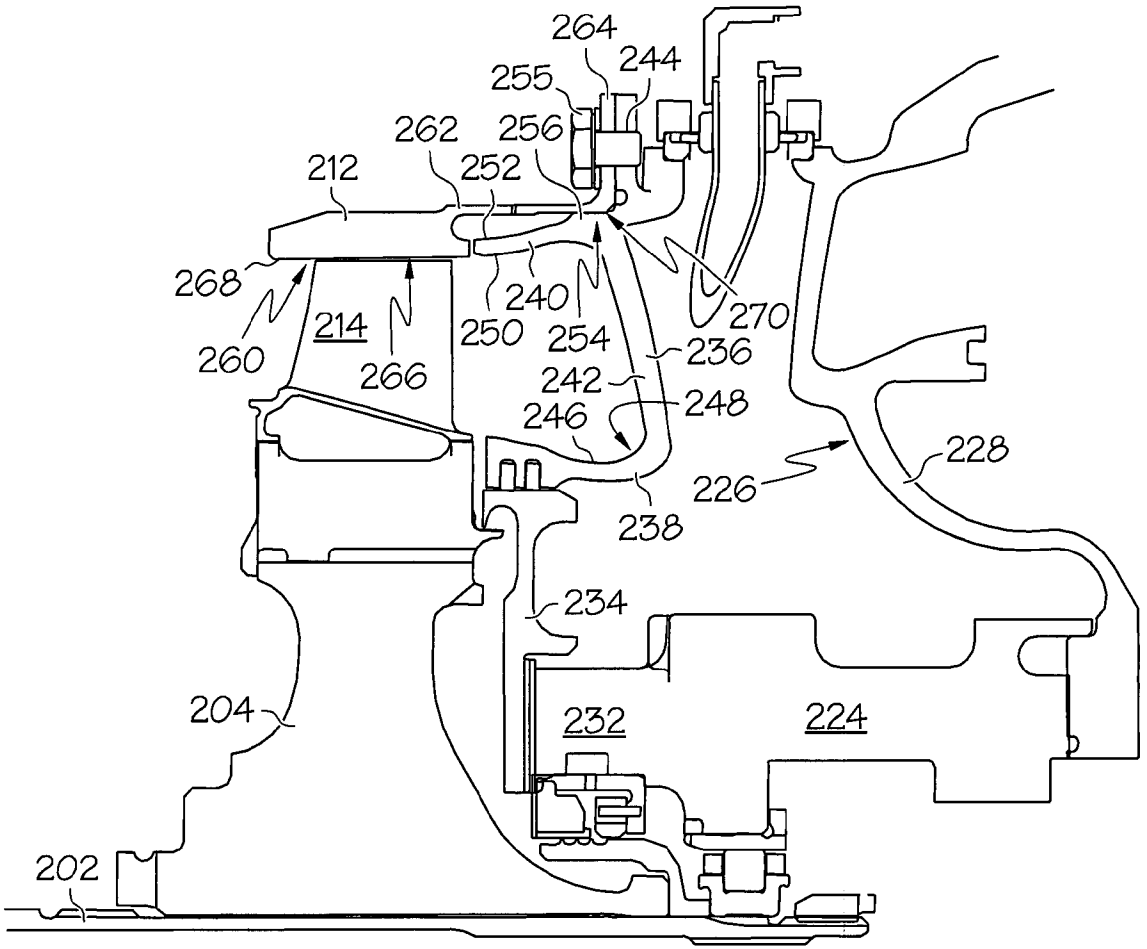
FIG. 3 is a close up view of a portion of the turbine section that includes an exemplary shroud.

The flowpath housing 226, a close up of which is provided in FIG. 3, includes a forward section 236 that is coupled to an aft section 228. Although the forward and aft sections 236, 228 are shown as two separate pieces, the sections 236, 228 form a single component in this embodiment. The forward section 236 is coupled to a forward end 232 of the bearing housing 224 and, in this embodiment, a plug 234 is disposed therebetween. The forward section 236 includes an inner cylinder 238, an outer cylinder 240, a plurality of struts 242, and a fastener flange 244. The inner cylinder 238 extends axially and includes an outer surface 246 that is coupled to the struts 242 at strut attachment points 248. The outer cylinder 240 is disposed concentric to the inner cylinder 238 and includes an inner surface 250 and an outer surface 252. The inner surface 250 is coupled to the struts 242 at strut attachment points 254, and the outer surface 252 includes a pilot 256 formed thereon. The pilot 256 is an annular protrusion that is configured to cooperate and mate with the shroud 212.

As briefly mentioned above, the plurality of struts 242 (only one of which is shown) extend between and are couple to the cylinders 238, 240 at the strut attachment points 248, 254, respectively. The struts 242 may be integrally formed as part of the cylinders 238, 230 or alternatively may be separately manufactured and subsequently welded thereto. Although a single strut 242 is shown in FIGS. 2 and 3, it will be appreciated that any suitable number of struts is typically employed.

As shown in more detail in FIG. 4, the fastener flange 244 extends radially outwardly from the outer cylinder 240; however, the particular location of the fastener flange 244 may be dependent upon the configuration of the shroud 212, as will be discussed in more detail below. The fastener flange 244 may be annular, or alternatively, may be a single piece protruding from the outer cylinder 240. In any case, the fastener flange 244 includes a fastener opening 258 formed therein that is configured to receive a fastener 255, such as a bolt, screw, or other conventional fastener for coupling the forward section 236 of the flowpath housing 226 with the shroud 212.

Figure 4:
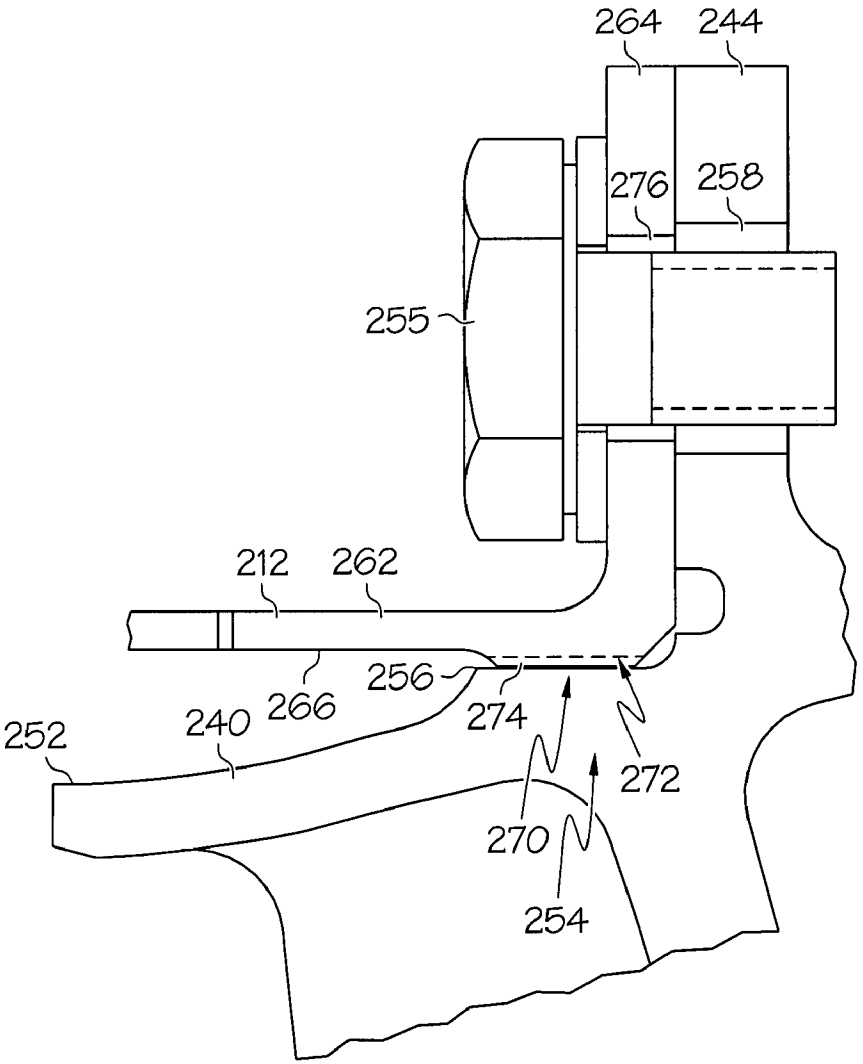
FIG. 4 is close up view of a portion of the exemplary shroud and of an exemplary flowpath housing.

With reference to FIGS. 3 and 4, the shroud 212 protects the high pressure turbine blades 214 from contacting other parts of the turbine section 200 and provides a sufficiently sized space within which the high pressure turbine blades 214 may rotate while allowing the blades 214 to radially expand upon exposure to high temperature energized air. The shroud 212 includes an axially extending ring 262 and a lip 264.

Figure 5:
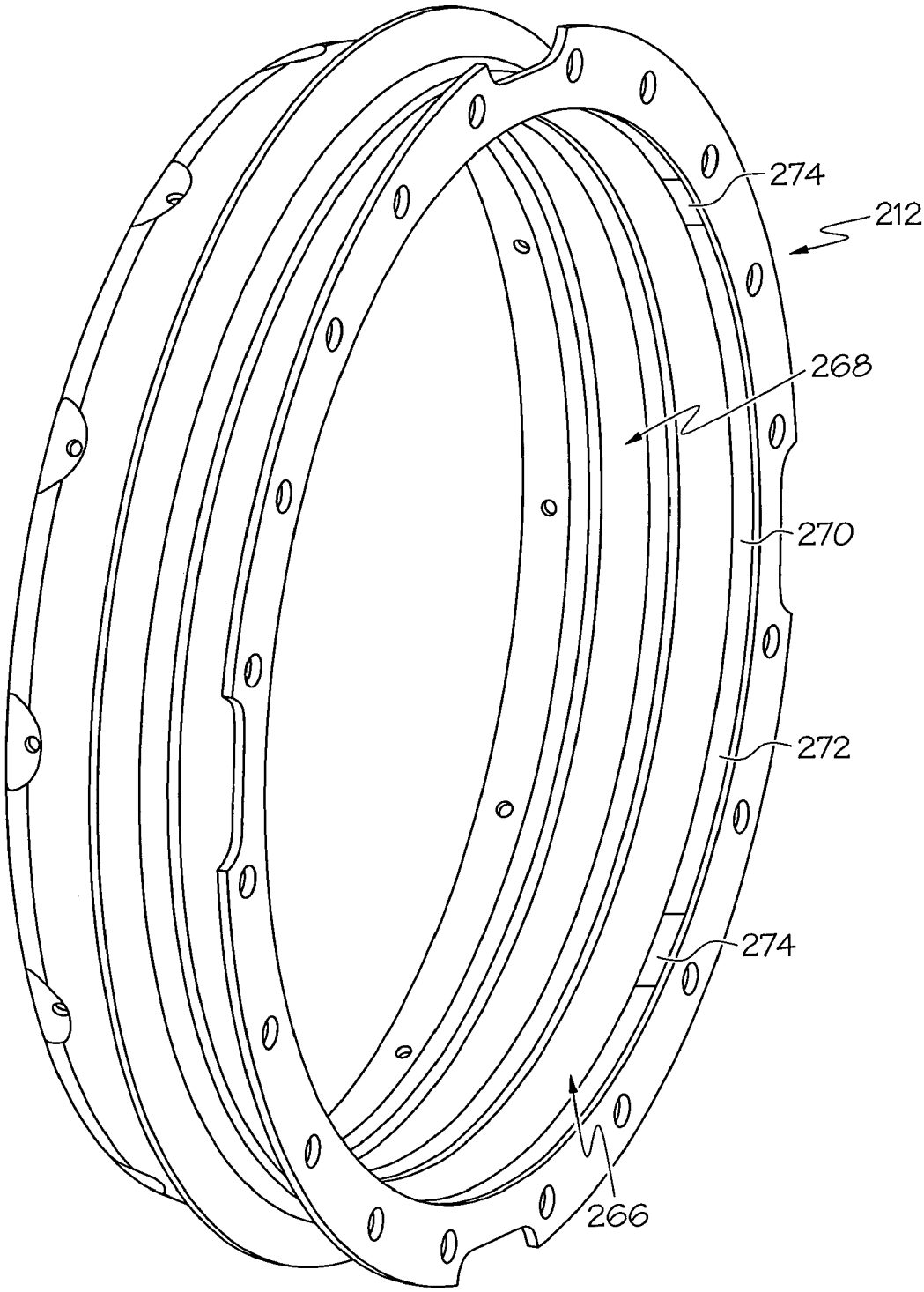
FIG. 5 is a perspective view of the exemplary shroud.

Preferably, the axially extending ring 262 has an inner surface 266 that includes two sections 268, 270. The first section 268 surrounds the blades 214 and defines a radial gap 260 therewith. The second section 270 is configured to cooperate with the lip 264 for coupling the shroud 212 to the flowpath housing outer cylinder 240. In this regard, the second section 270 includes a pilot 272 that is an annular protrusion extending radially inwardly and is configured to correspond to and mate with the flowpath housing pilot 256. Shown in phantom in FIG. 4 and in more detail in FIG. 5, the shroud pilot 272 includes a series of grooves 274 formed therein that are suitably spaced apart to correspond and align with the outer cylinder strut attachment points 254. Additionally, each groove 274 has a depth that is sufficient to provide and maintain a gap between the pilot 256 and the shroud 212 at least when the flowpath housing 226 is exposed to heat and the struts 242 radially expand.

The lip 264 extends radially outwardly from an aft end of the axially extending ring 262. It will be appreciated that the lip 264 may extend from any suitable section of the axially extending ring 262 and the particular placement of the lip 264 may depend on the configuration of the flowpath housing fastener flange 244. The lip 264 may be annular or may alternatively be radially extending pieces. In any case, the lip 264 includes at least one fastener opening 276 that corresponds with at least one of the fastener openings 258 of the fastener flange 244 to thereby couple the shroud 212 to the flowpath housing 226.

A shroud has now been provided that protects turbine blades while allowing the flowpath housing to radially expand without compromising the configuration of the clearance gap. Additionally, the shroud is simple and inexpensive to manufacture and to implement. Moreover, the shroud configuration may alternatively be retrofitted into existing shrouds.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A turbine section of an engine comprising:

a shaft;

a plurality of blades extending radially relative to the shaft;

a bearing assembly mounted to the shaft adjacent to the plurality of blades;

a flowpath housing coupled to the bearing assembly and including an inner cylinder, an outer cylinder, and a plurality of struts, the inner and outer cylinders each including a plurality of strut attachment points between which the plurality of struts are coupled, and the outer cylinder including an outer surface; and a shroud disposed concentric to the outer cylinder and having an inner surface including a groove formed therein that is substantially aligned with the outer cylinder strut attachment points, the groove having a depth that provides and maintains a gap between the outer cylinder outer surface and the shroud inner surface when the flowpath housing is exposed to heat and the struts radially expand.

2. The turbine section of claim 1, wherein the flowpath housing further includes a flange radially extending from an end of the outer cylinder outer surface, the flange including a fastener opening formed therein.

3. The turbine section of claim 2, wherein the flange is annular.

4. The turbine section of claim 2, wherein the shroud further includes a lip radially extending therefrom including a fastener opening formed in the lip that corresponds with the flange fastener opening.

5. The turbine section of claim 4, wherein the lip is annular.

6. The turbine section of claim 1, wherein the inner surface includes a plurality of grooves formed therein and the grooves are substantially aligned with the plurality of outer cylinder strut attachment points.

7. The turbine section of claim 1, wherein the shroud includes an annular protrusion formed in the shroud inner surface and the groove is formed in the annular protrusion.

8. The turbine section of claim 7, wherein the flowpath housing outer cylinder outer surface includes an annular protrusion extending radially therefrom that is configured to correspond to the shroud annular protrusion.

9. A turbine section of an engine comprising:

a shaft;

a plurality of blades extending radially relative to the shaft;

a bearing assembly mounted to the shaft adjacent to the plurality of blades;

a flowpath housing coupled to the bearing assembly and including an inner cylinder, an outer cylinder, and a plurality of struts, the inner and outer cylinders each including a plurality of strut attachment points between which the plurality of struts extend, and the outer cylinder including an outer surface and an annular protrusion formed on the outer surface; and a shroud disposed concentric to the outer cylinder and having an inner surface and an annular protrusion formed on the inner surface, the annular protrusion configured to mate with the flowpath housing annular protrusion and including a plurality of grooves formed therein, at least one groove corresponding to and aligned with selected ones of the outer cylinder strut attachment points and having a depth that provides a gap between the outer cylinder outer surface and the shroud inner surface that is maintained when the flowpath housing is exposed to heat and one or more struts of the plurality of struts radially expands.

10. The turbine section of claim 9, wherein the flowpath housing further includes a flange radially extending from an end of the outer cylinder outer surface, the flange including a fastener opening formed therein.

11. The turbine section of claim 10, wherein the flange is annular.

12. The turbine section of claim 10, wherein the shroud further includes a lip radially extending therefrom that includes a fastener opening formed in the lip that corresponds with the flange fastener opening.

13. The turbine section of claim 12, wherein the lip is annular.

14. A turbine section of an engine comprising:

a shaft;

a plurality of blades extending radially relative to the shaft;

a bearing assembly mounted to the shaft adjacent to the plurality of blades;

a flowpath housing coupled to the bearing assembly including an inner cylinder, an outer cylinder, and a plurality of struts, the inner and outer cylinders each including strut attachment points between which the plurality of struts are coupled, the outer cylinder including an outer surface, and the plurality of struts disposed in a predetermined pattern; and a shroud disposed concentric to the outer cylinder and including an inner surface having a plurality of grooves formed therein, at least one of the plurality of grooves aligned with selected ones of the outer cylinder strut attachment points and having a depth that is configured to provide a gap between the outer cylinder outer surface and the inner surface that is maintained when the flowpath housing is exposed to heat and at least one strut of the plurality of struts radially expands.

15. The turbine section of claim 14, wherein the flowpath housing further includes a flange radially extending from an end of the outer cylinder outer surface, the flange including a fastener opening formed therein.

16. The turbine section of claim 15, wherein the flange is annular.

17. The turbine section of claim 15, wherein the shroud further includes a lip radially extending therefrom including a fastener opening formed in the lip that corresponds with the flange fastener opening.

18. The turbine section of claim 14, wherein the shroud includes an annular protrusion formed in the shroud inner surface and the plurality of grooves are formed in the annular protrusion.

19. The turbine section of claim 18, wherein the flowpath housing outer cylinder outer surface includes an annular protrusion extending radially therefrom that is configured to correspond to the shroud annular protrusion.

* * * * *